US008305300B2

(12) United States Patent
Mima et al.

(10) Patent No.: US 8,305,300 B2
(45) **Date of Patent: *Nov. 6, 2012**

(54) METHOD FOR DRIVING PLASMA DISPLAY PANEL AND PLASMA DISPLAY DEVICE

(75) Inventors: Kunihiro Mima, Kyoto (JP); Kosuke Makino, Osaka (JP); Tooru Kawase, Osaka (JP)

(73) Assignee: Panasonic Corporation, Osaka (JP)

( * ) Notice: Subject to any disclaimer, the term of this patent is extended or adjusted under 35 U.S.C. 154(b) by 47 days.

This patent is subject to a terminal disclaimer.

(21) Appl. No.: 11/816,030

(22) PCT Filed: Feb. 26, 2007

(86) PCT No.: PCT/JP2007/053473

§ 371 (c)(1),
(2), (4) Date: Aug. 10, 2007

(87) PCT Pub. No.: WO2007/099891

PCT Pub. Date: Sep. 7, 2007

(65) Prior Publication Data

US 2009/0207161 A1 Aug. 20, 2009

(30) Foreign Application Priority Data

Feb. 28, 2006 (JP) ..... 2006-051739

(51) Int. Cl.
*G09G 3/28* (2006.01)

(52) U.S. Cl. ..... 345/63; 345/60; 345/67; 345/690; 345/208; 345/209; 345/210; 315/169.4

(58) Field of Classification Search ..... 345/55, 345/208–214, 60–72; 315/169.4
See application file for complete search history.

(56) References Cited

U.S. PATENT DOCUMENTS 6,294,875 B1 9/2001 Kurata et al.
7,561,122 B2 * 7/2009 Choi et al. ..... 345/67
8,085,222 B2 * 12/2011 Okada et al. ..... 345/63

(Continued)

FOREIGN PATENT DOCUMENTS

CN 1271158 A 10/2000

(Continued)

OTHER PUBLICATIONS

Japanese language International Search Report for PCT/JP2007/053473, dated Apr. 3, 2007.

(Continued)

*Primary Examiner* — Lun-Yi Lao
*Assistant Examiner* — Olga Merkoulova
(74) *Attorney, Agent, or Firm* — RatnerPrestia

(57) ABSTRACT

The method for driving a plasma display panel effects control of the sub-fields in a manner that at least one sub-filed carries out, in its initializing period, an all-cell initializing operation on the discharge cells and the plurality of sub-fields other than the aforementioned sub-field selectively carry out an addressing operation in each discharge cell; at the same time, two or more predetermined sub-fields carry out an addressing operation only when at least one sub-field had an addressing operation after the all-cells initializing operation; and an unusual-charge erase period, where scan electrodes SC-SCn undergo application of voltage with a rectangular waveform, is provided after the initializing period of at least one sub-field of the predetermined sub-fields.

4 Claims, 11 Drawing Sheets

U.S. PATENT DOCUMENTS

| | | | | |
|---|---|---|---|---|
| 2002/0093291 | A1* | 7/2002 | Kanazawa et al. | 315/169.4 |
| 2004/0113871 | A1* | 6/2004 | Kashio et al. | 345/63 |
| 2004/0155836 | A1 | 8/2004 | Kim | |
| 2005/0225509 | A1* | 10/2005 | Choi et al. | 345/60 |
| 2008/0048937 | A1 | 2/2008 | Ogawa | |
| 2009/0096719 | A1* | 4/2009 | Yoshihama et al. | 345/60 |

FOREIGN PATENT DOCUMENTS

| | | | |
|---|---|---|---|
| EP | 2063410 | A1 | 5/2009 |
| JP | 2000-242224 | A | 9/2000 |
| JP | 2004-109838 | A | 4/2004 |
| JP | 2004-191530 | A | 7/2004 |
| JP | 2004-326068 | A | 11/2004 |
| KR | 10-2004-0091878 | | 11/2004 |
| WO | WO-2005111974 | A1 | 11/2005 |

OTHER PUBLICATIONS

Chinese Office Action for CN 2007800004689, Nov. 6, 2009.

European Application Serial No. 07714905.2, Extended European Search Report mailed Dec. 22, 2011, 10 pgs.

* cited by examiner

FIG. 8

Gradation level / Luminance factor

| Sub-field | 1 | 2 | 3 | 4 | 5 | 6 | 7 | 8 | 9 | 10 |
|---|---|---|---|---|---|---|---|---|---|---|
| | 1 | 2 | 3 | 6 | 11 | 18 | 30 | 44 | 60 | 80 |
| 0 | – | – | – | – | – | – | – | – | – | – |
| 1 | ○ | – | – | – | – | – | – | – | – | – |
| 2 | – | ○ | – | – | – | – | – | – | – | – |
| 3 | ○ | ○ | – | – | – | – | – | – | – | – |
| 4 | ○ | – | ○ | – | – | – | – | – | – | – |
| 5 | – | ○ | ○ | – | – | – | – | – | – | – |
| 6 | ○ | ○ | ○ | – | – | – | – | – | – | – |
| 7 | ○ | – | – | ○ | – | – | – | – | – | – |
| 8 | – | ○ | – | ○ | – | – | – | – | – | – |
| 9 | ○ | ○ | – | ○ | – | – | – | – | – | – |
| 10 | ○ | – | ○ | ○ | – | – | – | – | – | – |
| 11 | – | ○ | ○ | ○ | – | – | – | – | – | – |
| 12 | ○ | ○ | ○ | ○ | – | – | – | – | – | – |
| 13 | – | ○ | – | – | ○ | – | – | – | – | – |
| 14 | ○ | ○ | – | – | ○ | – | – | – | – | – |
| 246 | ○ | ○ | – | – | ○ | ○ | ○ | ○ | ○ | ○ |
| 247 | ○ | – | ○ | – | ○ | ○ | ○ | ○ | ○ | ○ |
| 248 | – | ○ | ○ | – | ○ | ○ | ○ | ○ | ○ | ○ |
| 249 | ○ | ○ | ○ | – | ○ | ○ | ○ | ○ | ○ | ○ |
| 250 | ○ | – | – | ○ | ○ | ○ | ○ | ○ | ○ | ○ |
| 251 | – | ○ | – | ○ | ○ | ○ | ○ | ○ | ○ | ○ |
| 252 | ○ | ○ | – | ○ | ○ | ○ | ○ | ○ | ○ | ○ |
| 253 | ○ | – | ○ | ○ | ○ | ○ | ○ | ○ | ○ | ○ |
| 254 | – | ○ | ○ | ○ | ○ | ○ | ○ | ○ | ○ | ○ |
| 255 | ○ | ○ | ○ | ○ | ○ | ○ | ○ | ○ | ○ | ○ |

METHOD FOR DRIVING PLASMA DISPLAY PANEL AND PLASMA DISPLAY DEVICE

This application is a U.S. National Phase Application of PCT International Application PCT/JP2007/053473.

TECHNICAL FIELD

The present invention relates to a method for driving a plasma display panel used for wall-mount TVs or large monitors and also relates to a plasma display device.

BACKGROUND ART

An AC-type surface discharge plasma display panel has become dominance in plasma display panels (hereinafter simply referred to as a panel). The panel contains a front plate and a back plate oppositely disposed with each other and a plurality of discharge cells therebetween. On a front glass substrate of the front plate, scan electrodes and sustain electrodes—a pair of each electrode forms a display electrode—are arranged in parallel with each other, and over which, a dielectric layer and a protective layer are formed to cover the display electrodes. On the other hand, on a back glass substrate of the back plate, data electrodes are disposed in a parallel arrangement, and over which, a dielectric layer is formed to cover the data electrodes. On the dielectric layer, a plurality of barrier ribs is formed in parallel with the arrays of the data electrodes. A phosphor layer is formed on the dielectric layer and on the side surfaces of the barrier ribs.

The front plate and the back plate are sealed with each other so that the display electrodes are orthogonal to the data electrodes in a discharge space between the two plates. The discharge space is filled with a discharge gas, for example, a gas containing 5% xenon in a ratio of partial pressure. The discharge cells are formed at which display electrodes face data electrodes. In the panel structured above, a gas discharge occurs in each discharge cell and generates ultraviolet light, which excites phosphors for red (R), green (G) and blue (B) to generate visible light of respective colors.

In the typical panel operation, one field is divided into a plurality of sub-fields, which is known as a sub-field method. According to the sub-field method, gradation display on the screen is attained by combination of the sub-fields to be lit. Each sub-field has a initializing period, an address period and a sustain period.

In the initializing period, a initializing discharge occurs in the discharge cells. The initializing discharge generates wall charge on each electrode as a preparation for the following addressing operation. There are two types of initializing operation carried out in the initializing period. One is the operation in which the initializing discharge occurs in all of the discharge cells (hereinafter refers to as an all-cell initializing operation), and the other is the operation in which the initializing discharge occurs only in a cell that had sustain discharge (hereinafter refers to as selective-cell initializing operation).

In the address period, address discharge selectively occurs in a cell to be ON to form the wall charge. In the sustain period successive to the address period, sustain pulses are alternately applied between the scan electrodes and the sustain electrodes. The application of pulses generates a sustain discharge in the cells in which the wall charges have been formed in the previous address discharge and excites the phosphor layer of the cells. Through the process above, image is shown on the panel.

In the sub-field methods, a new driving method is disclosed. According to the disclosure, an effective use of the all-cell initializing operation by the application of voltage with a gradually varying waveform and the selective-cell initializing operation can suppress light-emitting that has no contribution to gradation display and therefore improves contrast ratio. Specifically, all of the discharge cells undergo the all-cell initializing operation in the initializing period of one sub-field. In each initializing period of other sub-fields, only a cell where a sustain discharge occurred undergoes the selective-cell initializing operation. As a result, a discharge cell with no contribution to image display has no light-emitting except for the light-emitting occurred in the all-cell initializing operation. This provides a panel with high-contrast image display (for example, see Japanese Patent Unexamined Publication No. 2000-242224).

In response to the recent trend of a larger panel with higher resolution, a suggestion has been made for the improvement of light-emitting efficiency by increasing partial pressure of xenon. Increase in partial pressure of xenon, however, can invite an unstable discharge, such as a delay in discharge. Unstable operations in the all-cell initializing operation can cause a discharge error—a sustain discharge occurs even in a cell without an address discharge. The operational failure (hereinafter, emitting error) can ruin the quality of image display.

SUMMARY OF THE INVENTION

The present invention discloses a method for driving a plasma display panel having a plurality of discharge cells with a display electrode formed of a scan electrode and a sustain electrode. According to the method, one field is formed of a plurality of sub-fields each of which has the following periods: a initializing period for generating a initializing discharge in the discharge cells; an address period for generating an address discharge caused by an addressing operation in a discharge cell; and a sustain period for generating a sustain discharge in a discharge cell where an address discharge occurred in the previous period. The driving method effects control of the sub-fields in a manner that at least one sub-filed carries out, in its initializing period, the all-cell initializing operation on the discharge cells and the plurality of sub-fields other than the aforementioned sub-field selectively carry out an addressing operation in each discharge cell; at the same time, two or more sub-fields carry out the addressing operation only when at least one sub-field had an addressing operation after the all-cells initializing operation; and an unusual-charge erase period—in which a scan electrode undergoes application of voltage with a rectangular waveform—is provided after the initializing period of at least one sub-field of the predetermined sub-fields.

The driving method structured above provides a initializing discharge with stability, improving quality of image display of a panel.

According to an aspect of the method for driving a panel of the present invention, an unusual-charge erase period—in which a scan electrode undergoes application of voltage with a rectangular waveform—is provided after the initializing period of the sub-field at the first of the predetermined sub-fields. The structure stabilizes initializing discharge.

According to another aspect of the method for driving a panel of the present invention, an unusual-charge erase period—in which a scan electrode undergoes application of voltage with a rectangular waveform—is provided after the initializing period of the sub-field at the second of the predetermined sub-fields. Addressing operations after the unusual-charge erase period enhance the stability of a initializing discharge.

The plasma display device of the present invention contains a plasma display panel having a plurality of discharge cells with a display electrode formed of a scan electrode and a sustain electrode; and a driving circuit for driving the plasma display panel with the use of a sub-field method. In the method, one field is formed of a plurality of sub-fields each of which has the following periods: a initializing period for generating a initializing discharge in the discharge cells; an address period for generating an address discharge caused by an addressing operation in a predetermined discharge cell of the discharge cells; and a sustain period for generating a sustain discharge in the predetermined discharge cell where an address discharge occurred in the previous period. The driving circuit effects control of the sub-fields in a manner that at least one sub-filed carries out the all-cell initializing operation on the discharge cells in its initializing period and other sub-fields selectively carry out an addressing operation in each discharge cell; at the same time, two or more sub-fields carry out an addressing operation only when at least one sub-field had an addressing operation after the all-cell initializing operation; and an unusual-charge erase period—in which a scan electrode undergoes application of voltage with a rectangular waveform—is provided after the initializing period of at least one sub-field of the predetermined sub-fields. The structure above contributes to a stabilized initializing discharge, allowing a plasma display panel to have excellent quality of image display.

BRIEF DESCRIPTION OF THE DRAWINGS

FIG. 8 shows the gradation levels and combination of the sub-fields having an addressing operation to achieve each level in accordance with the first exemplary embodiment.

REFERENCE MARKS IN THE DRAWINGS

Figure 1:
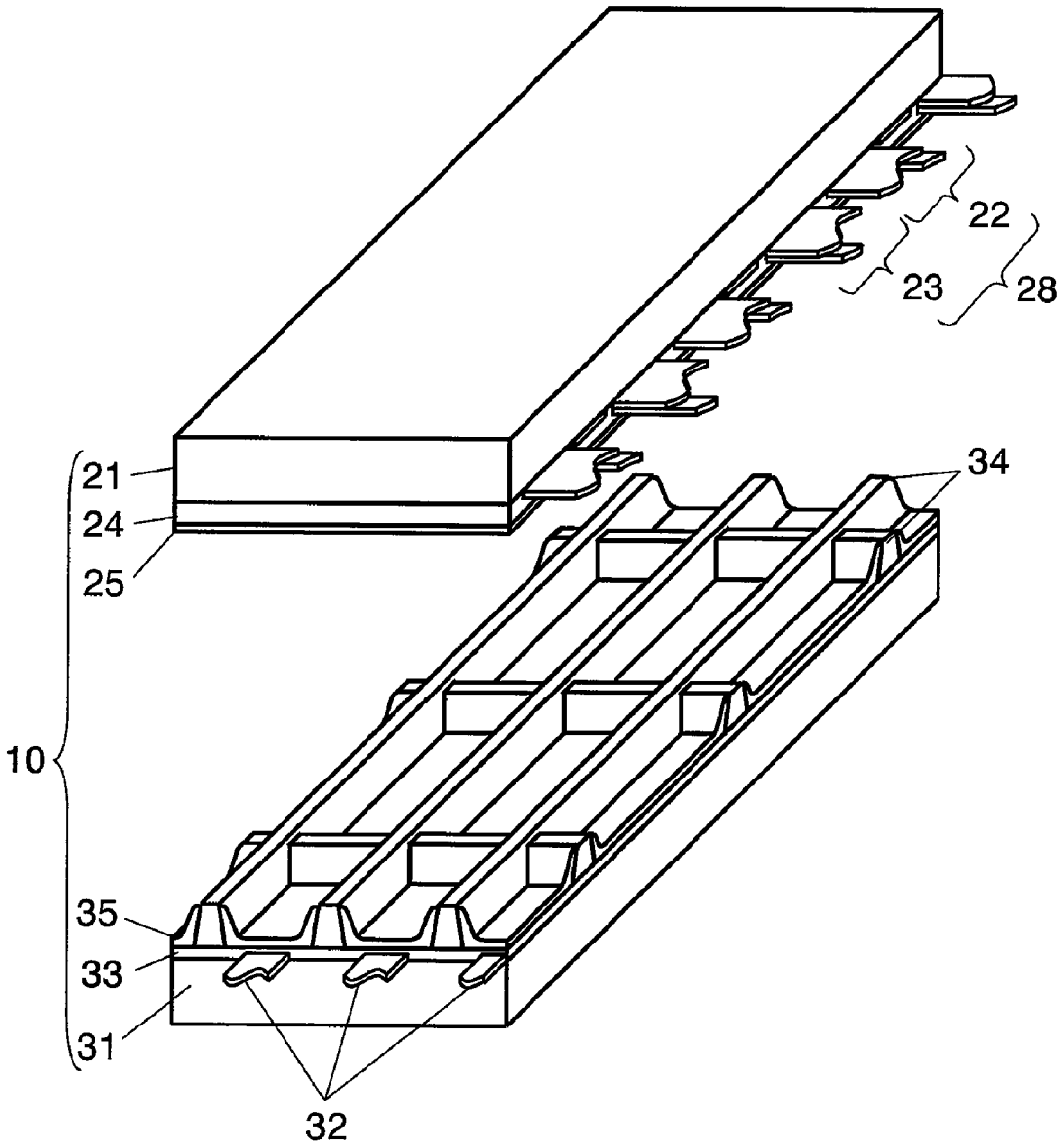
FIG. 1 is an exploded perspective view showing the structure of a panel in accordance with a first exemplary embodiment of the present invention.

1 plasma display device
10 panel (plasma display panel)
21 front plate
22 scan electrode
23 sustain electrode
24, 33 dielectric layer
25 protective layer
28 display electrode
31 back plate
32 data electrode
34 barrier rib
35 phosphor layer
40 driving voltage waveform (provided in an unusual-charge erase period)
51 image-signal processing circuit
52 data-electrode driving circuit
53 scan-electrode driving circuit
54 sustain-electrode driving circuit
55 timing-signal generating circuit
100 sustain-pulse generating circuit
300 initializing-waveform generating circuit
400 scan-pulse generating circuit
SC1-SCn scan electrodes
SU1-SUn sustain electrodes
D1-Dm data electrodes

DETAILED DESCRIPTION OF THE PREFERRED EMBODIMENTS

The exemplary embodiments of the present invention are described hereinafter with reference to the accompanying drawings.

First Exemplary Embodiment

FIG. 1 is an exploded perspective view showing the structure of panel 10 in accordance with the first exemplary embodiment. Glass-made front plate 21 has a plurality of display electrodes 28 each of which is formed of a pair of one of scan electrodes 22 and one of sustain electrodes 23. Scan electrodes 22 and sustain electrodes 23 are covered with dielectric layer 24, and over which, protective layer 25 is formed. On the other hand, back plate 31 has a plurality of data electrodes 32. Data electrodes 32 are covered with dielectric layer 33, and over which, barrier rib 34 is formed so as to have a grid shape. Phosphor layer 35 for emitting red (R), green (G) and blue (B) is disposed on dielectric layer 33 and on the side of barrier ribs 34.

Front plate 21 and back plate 31 are oppositely disposed so that display electrodes 28 are located orthogonal to data electrodes 32 through a narrow discharge space. The two plates are sealed with a sealing compound, such as glass frit. The discharge space between the plates is filled with discharge gas, for example, a mixed gas of neon and xenon. To improve luminance, the first exemplary embodiment employs a discharge gas containing xenon with a partial pressure of 10%. The discharge space is divided into a plurality of sections by barrier rib 34. Discharge cells are formed at intersections of display electrodes 28 and data electrodes 32. Through the discharge and light-emitting processes, image appears on the panel.

Panel 10 does not necessarily have the structure above; the barrier rib may be formed into stripes.

Figure 2:
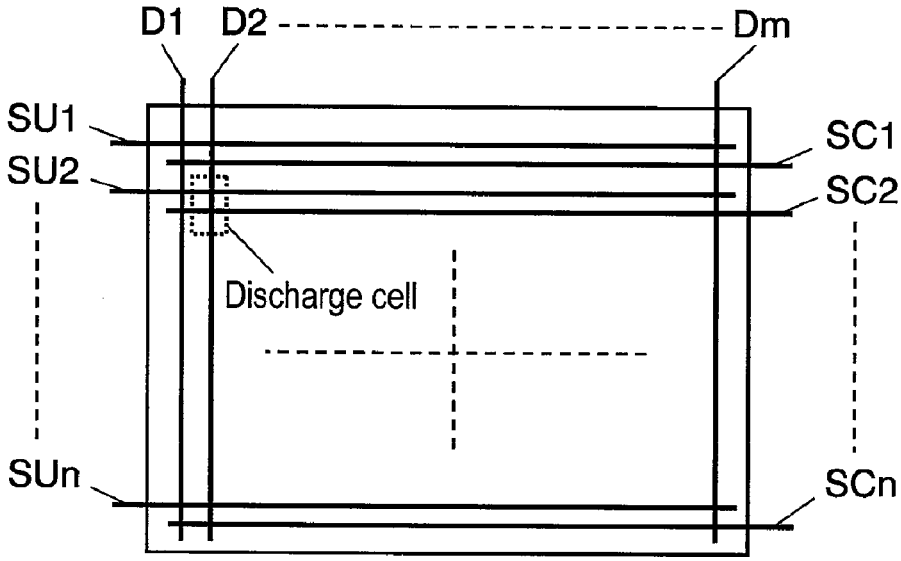
FIG. 2 shows arrangement of electrodes on the panel in accordance with the first exemplary embodiment.

FIG. 2 shows an electrode layout of panel 10 in accordance with the first exemplary embodiment. In the horizontal direction, panel 10 has n long scan electrodes SC1-SCn (corresponding to scan electrodes 22 in FIG. 1) and n long sustain electrodes SU1-SUn (corresponding to sustain electrodes 23 in FIG. 1). In the vertical direction, panel 10 has m long data electrodes D1-Dm (corresponding to data electrodes 32 in FIG. 1). A discharge cell is formed at an intersection of a pair of scan electrode SCi and sustain electrode SUi (where, i takes 1 to n) and data electrode Dj (where, j takes 1 to m). That is, panel 10 contains m×n discharge cells in the discharge space.

Figure 3:
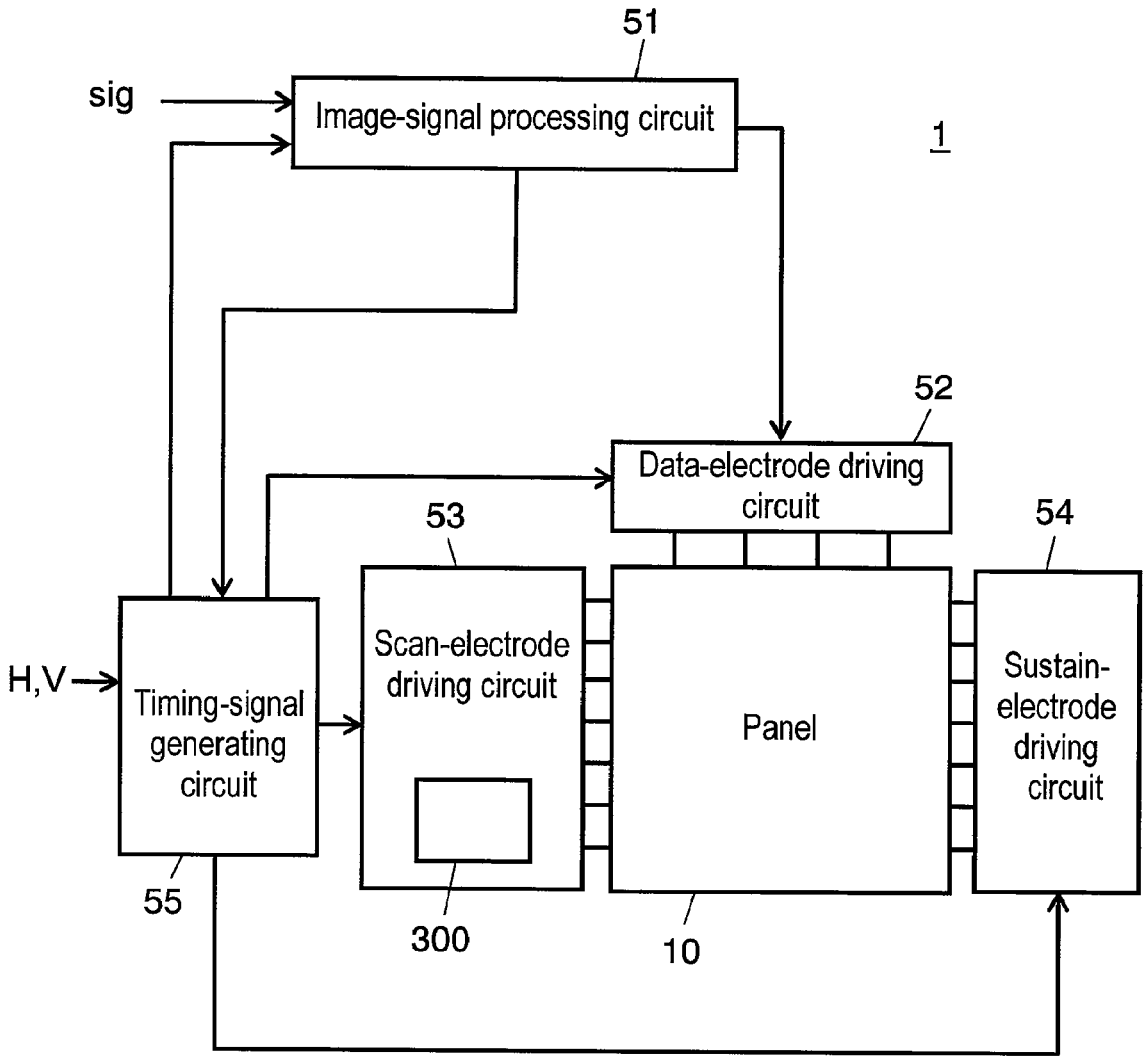
FIG. 3 is a circuit block diagram of a driving circuit for driving the panel in accordance with the first exemplary embodiment.

FIG. 3 is a circuit block diagram of the driving circuit that drives panel 10 of the first exemplary embodiment. Plasma display device 1 has panel 10, image-signal processing circuit 51, data-electrode driving circuit 52, scan-electrode driving circuit 53, sustain-electrode driving circuit 54, timing-signal generating circuit 55 and a power supply circuit (not shown) for supplying power to each circuit block.

Receiving image signal sig, image-signal processing circuit 51 converts it into image data for light-emitting or non-light-emitting on a sub-field basis. Data-electrode driving circuit 52 converts the image data of each sub-field into a signal suitable for data electrodes D1-Dm to drive them. Timing-signal generating circuit 55 generates timing signals that control each circuit block according to horizontal synchronizing signal H and vertical synchronizing signal V, and the timing signals are fed to each circuit block. Scan-electrode driving circuit 53 has initializing-waveform generating circuit 300 for generating initializing voltage waveform to be applied to scan electrodes SC1-SCn in a initializing period. Receiving the timing signals, scan-electrode driving circuit 53 drives scan electrodes SC1-SCn. Similarly, receiving the timing signals, sustain-electrode driving circuit 54 drives sustain electrodes SU1-SUn.

Next will be described the driving voltage waveforms and how they work on panel 10. Plasma display device 1 employs the sub-field method to provide gradation. In the method, one field is divided into a plurality of sub-fields. Light-emitting control of the discharge cells is carried out on a sub-field basis. Each sub-field has the initializing period, the address period and the sustain period. According to the first exemplary embodiment, an unusual-charge erase period is set between the rest period and the address period as necessary.

The initializing period is responsible for generating a initializing discharge to form wall charges on each electrode as a preparation for an address discharge that follows the initializing discharge. Two types of initializing operations are selectively carried out in the initializing period: an all-cell initializing operation and a selective-cell initializing operation.

If the all-cell initializing operation in the initializing period loses stability, unusual-charges can be built up in a discharge cell. The unusual-charge erase period successive to the initializing period is responsible for erasing the unusual-charges in the discharge cell.

The address period is responsible for selectively generating an address discharge in a discharge cell to be lit and forming wall charge. The sustain period is responsible for generating a sustain discharge; specifically, sustain pulses are alternately applied to display electrodes 28 so that a sustain discharge occurs in the discharge cell in which the address discharge occurred. The number of the pulses applied to display electrodes 28 is proportionate to a luminance weight for light emitting.

Descriptions in the first exemplary embodiment will be given on the assumption that one field is divided into ten sub-fields from the first sub-field (1SF) to the tenth sub-field (10SF) and 1SF through 10SF have the following luminance weights in the order named: 1, 2, 3, 6, 11, 18, 30, 44, 60 and 80.

Figure 4:
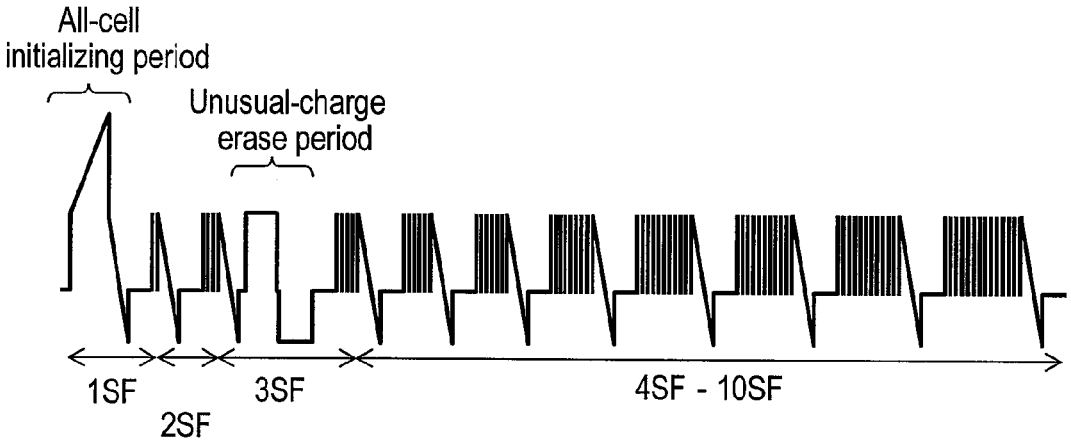
FIG. 4 shows the structure of the sub-fields in accordance with the first exemplary embodiment.

FIG. 4 shows the structure of the sub-fields in accordance with the first exemplary embodiment. In the embodiment, 1SF is the all-cell initializing sub-field, while 2SF through 10SF are the selective-cell rest sub-fields. Of the ten sub-fields, 3SF only has the unusual-charge erase period. FIG. 4 shows the driving voltage waveform of one field applied to the scan electrodes.

Figure 5:
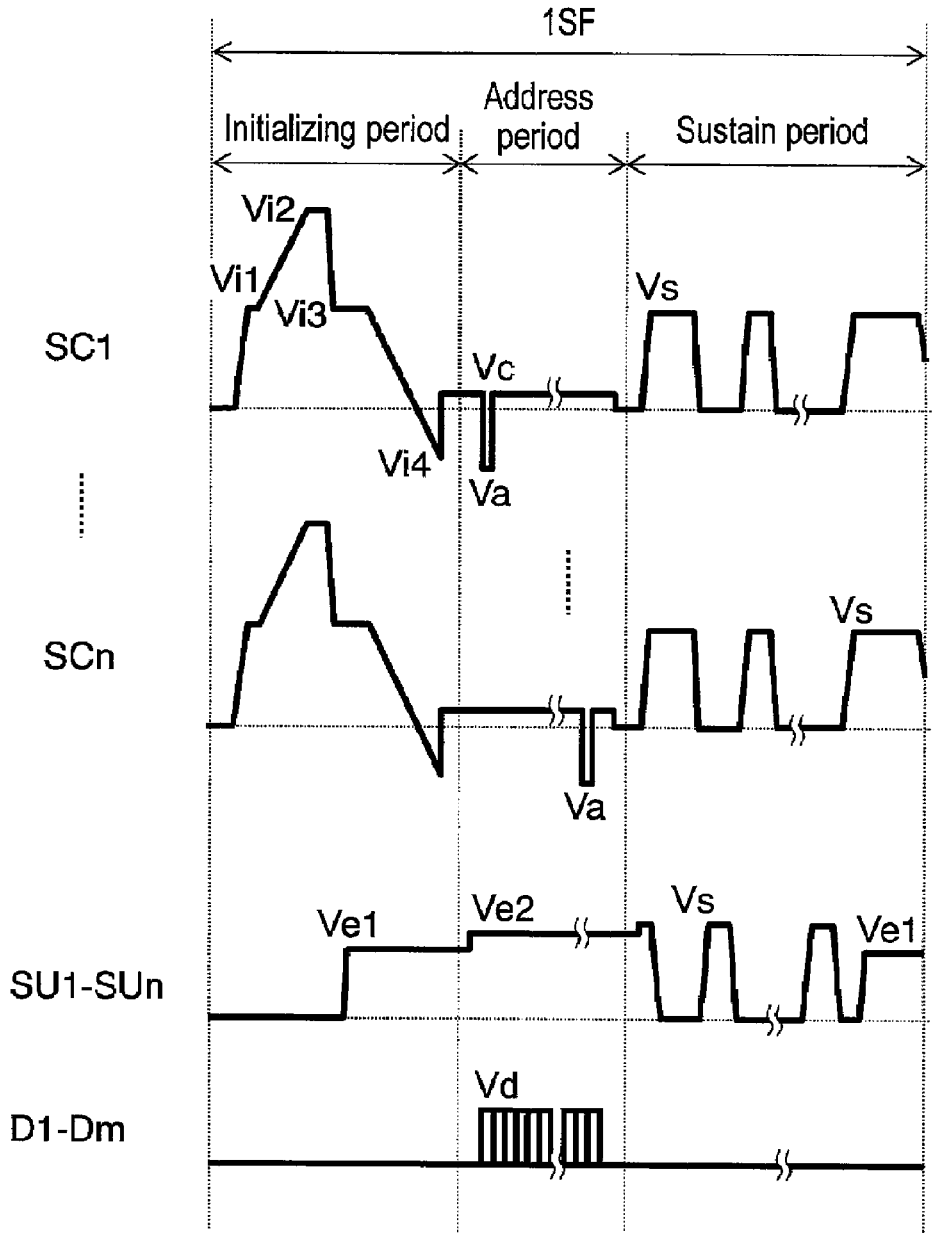
FIG. 5 illustrates the driving voltage waveforms applied to each electrode in the first sub-field (1SF) of the panel in accordance with the first exemplary embodiment.

FIG. 5 illustrates a driving voltage waveform applied to each electrode in 1SF of panel 10. 1SF is the sub-field in which the all-cell initializing operation is carried out (hereinafter, all-cell initializing sub-field) and has no unusual-charge erase period.

In the first half of the initializing period of 1SF, data electrodes D1-Dm and sustain electrodes SU1-SUn undergo application of voltage of zero (0V), while scan electrodes SC1-SCn undergo application of voltage with gradually increasing waveform, starting from voltage Vi1 (that is lower than the discharge start voltage for sustain electrodes SU1-SUn) toward voltage Vi2 (that exceeds the discharge start voltage).

During the application of voltage with gradual increase, a weak initializing discharge occurs between scan electrodes SC1-SCn, sustain electrodes SU1-SUn and data electrodes D1-Dm. Through the initializing discharge, negative wall voltage is built up on scan electrodes SC1-SCn and positive wall voltage is built up on data electrodes D1-Dm and sustain electrodes SU1-SUn. The wall voltage on each electrode represents a voltage generated by wall charges built up on the dielectric layer, the protective layer and the phosphor layer on the electrodes.

In the latter half of the initializing period, sustain electrodes SU1-SUn undergo application of positive voltage Ve1, while scan electrodes SC1-SCn undergo application of voltage with gradually decreasing waveform, starting from voltage Vi3 (that is lower than the discharge start voltage for sustain electrodes SU1-SUn) toward voltage Vi4 (that exceeds the discharge start voltage). During the application of voltage with gradual decrease, a weak initializing discharge occurs between scan electrodes SC1-SCn, sustain electrodes SU1-SUn and data electrodes D1-Dm. Through the discharge, the negative wall voltage on scan electrodes SC1-SCn and the positive wall voltage on sustain electrodes SU1-SUn are weakened. The positive wall voltage on data electrodes D1-Dm is adjusted to a value suitable for the addressing operation. In this way, the initializing discharge given on all the discharge cells, i.e., the all-cell initializing operation is completed.

The description above holds true for the case where the all-cell initializing operation is successfully carried out; an unstable discharge, such as a discharge with perceptible delay can cause problems. Under the unstable condition, in spite of the application of voltage with gradually changing waveform, a strong discharge can occur between scan electrodes SC1-SCn and data electrodes D1-Dm, or between scan electrodes SC1-SCn and sustain electrodes SU1-SUn. When such a strong discharge (hereinafter referred to as an abnormal initializing discharge) occurs in the latter half of the all-cell initializing period, positive wall voltage is built up on scan electrodes SC1-SCn and negative wall voltage is built up on sustain electrodes SU1-SUn. Similarly, data electrodes D1-Dm carries positive or negative wall voltage. Once the abnormal initializing discharge occurs in the first half of the all-cell initializing period, the abnormal initializing discharge appears again in the latter half of the period, by which the aforementioned wall voltage is built up on each electrode. Hereinafter, the wall voltage generated by the abnormal initializing discharge is referred to unusual-charge because of its ill effect on normal operations of the discharge cells.

In the address period that follows the initializing period, sustain electrodes SU1-SUn undergo application of voltage Ve2 and scan electrodes SC1-SCn undergo application of voltage Vc.

Next, negative scan pulse voltage Va is applied to scan electrode SC1 located at the first row, and positive address pulse voltage Vd is applied to data electrode Dk (k takes 1 to m), which corresponds to the discharge cell to be lit at the first row, in data electrodes D1-Dm. At this time, difference in voltage at the intersection of data electrode Dk and scan electrode SC1 is calculated by adding the difference in wall voltage between data electrode Dk and scan electrode SC1 to the difference in voltage applied from outside (i.e., Vd-Va). The calculated value exceeds the discharge start voltage, thereby generating an address discharge between data electrode Dk and scan electrode SC1, and between sustain electrode SU1 and scan electrode SC1. Through the address discharge, positive wall voltage is built up on scan electrode SC1 and negative wall voltage is built up on sustain electrode SU1 and data electrode Dk.

In an addressing operation, as described above, an address discharge is generated so as to build up wall voltage on each electrode in the discharge cell to be lit at the first row. On the other hand, the voltage, which measures at the intersection of scan electrode SC1 and data electrodes D1-Dm other than electrode Dk (i.e., the data electrodes with no application of address pulse voltage Vd), is too small to generate an address discharge. After the addressing operation is repeatedly carried out until the discharge cells located in the $n^{th}$ row, the address period is completed.

In a discharge cell where each electrode carries unusual-charge, a normal address discharge cannot be expected due to lack of wall voltage for generating an address discharge.

In the sustain period that follows the address period, positive sustain pulse voltage Vs is applied to scan electrodes SC1-SCn, and at the same time, voltage of zero (0V) is applied to sustain electrodes SU1-SUn. In the discharge cell where an address discharge occurred in the previous period, difference between the voltage on scan electrode SCi and the voltage on sustain electrode SUi is calculated by adding sustain pulse voltage Vs to the difference between the wall voltage on scan electrode SCi and the wall voltage on sustain electrode SUi. The calculated value exceeds the discharge start voltage, thereby generating a sustain discharge between scan electrode SCi and sustain electrode SUi. The sustain discharge produces ultraviolet light, allowing phosphor layer 35 to emit light. Negative wall voltage is built up on scan electrode SCi and positive wall voltage is built up on sustain electrode SUi and data electrode Dk. A discharge cell without an address discharge in the previous address period has no sustain discharge and therefore maintains the wall voltage the same as that at the end of the initializing period.

Next, voltage of zero (0V) is applied to scan electrodes SC1-SCn and sustain pulse voltage Vs is applied to sustain electrodes SU1-SUn. In the discharge cell where a sustain discharge occurred, difference between the voltage on sustain electrode SUi and the voltage on scan electrode SCi exceeds the discharge start voltage, thereby generating a sustain discharge again between sustain electrode SUi and scan electrode SCi. Through the discharge, negative wall voltage is built up on sustain electrode SUi and positive wall voltage is built up on scan electrode SCi. In this way, scan electrodes SC1-SCn and sustain electrodes SU1-SUn alternately undergo sustain pulses (where the number of the pulses to be applied are determined by multiplying a luminance weight by a luminance factor), providing difference in voltage between a scan electrode and a sustain electrode. This allows the sustain discharge to repeatedly occur in a discharge cell where an address discharge occurred in the address period.

At the end of the sustain period, providing difference in voltage having a narrow-width pulse shape between scan electrodes SC1-SCn and sustain electrodes SU1-SUn erases wall voltage on scan electrode SCi and sustain electrode SUi, with the positive wall voltage on data electrode Dk maintained.

In a discharge cell with a built-up of unusual-charges, for example, in a cell where scan electrode SCp (p takes 1 to n) carries positive wall voltage and sustain electrode SUp carries negative wall voltage, a sustain discharge can occur; the unusual-charge is not sufficient in magnitude for constantly generating a sustain discharge. In addition, a sustain discharge may not occur in the first sub-field, but in the successive sub-field. In a discharge cell that carries unusual-charges, there is a possibility that a sustain discharge occurs when sustain voltage Vs is applied to either scan electrode or sustain electrode of display electrode 28. However, in a case where a sustain discharge has occurred in the sustain period, the initializing period of the successive sub-field normally carries out initializing operation and the successive operations after the initializing operation are normally carried out.

Figure 6:
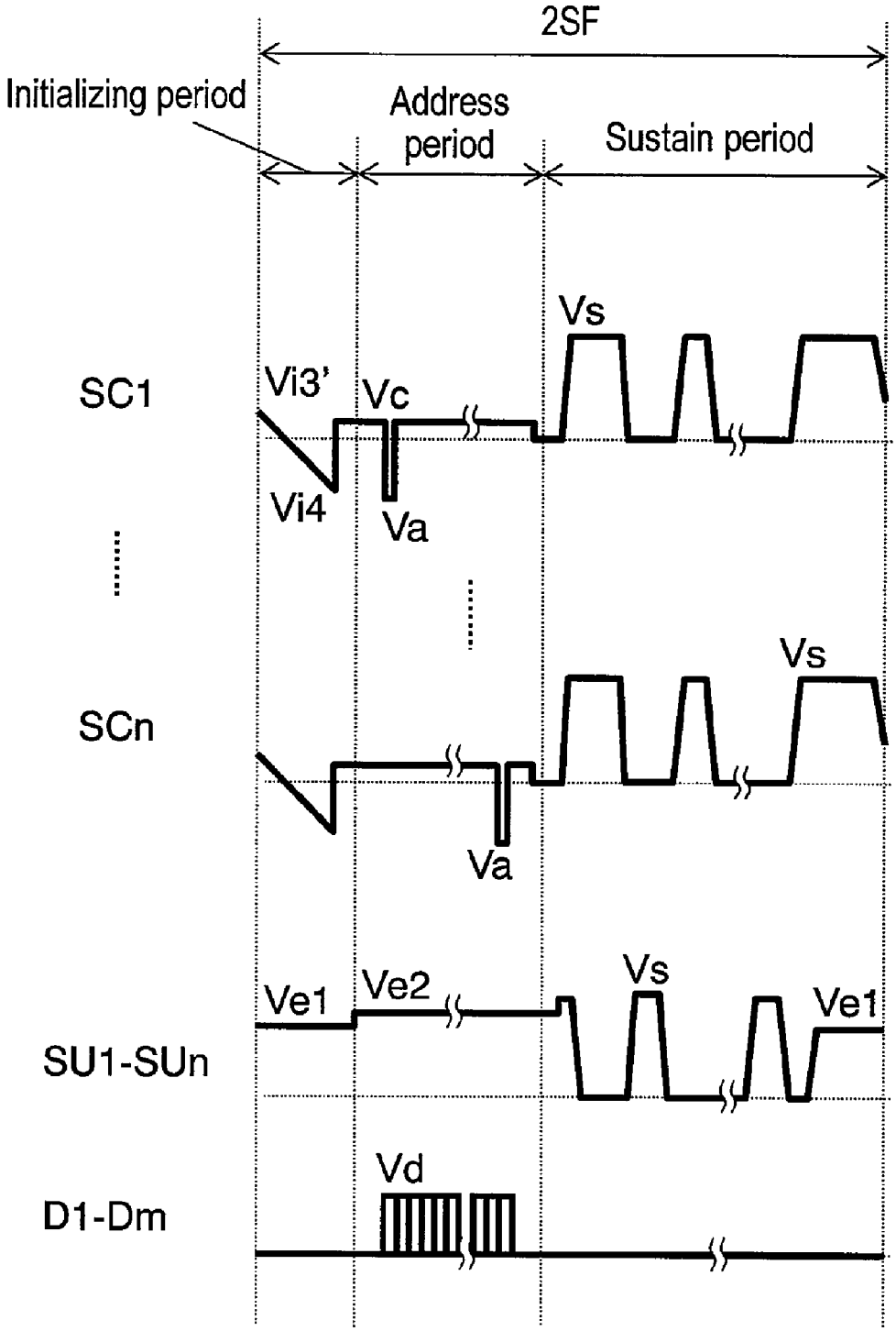
FIG. 6 illustrates the driving voltage waveforms applied to each electrode in the second sub-field (2SF) of the panel in accordance with the first exemplary embodiment.

FIG. 6 illustrates a driving voltage waveform applied to each electrode in the second sub-field (2SF) of panel 10. 2SF is the sub-field in which the selective-cell initializing operation is carried out (hereinafter, selective-cell initializing sub-field) and has no unusual-charge erase period.

In the selective-cell initializing operation of the initializing period, sustain electrodes SU1-SUn undergo application of voltage Ve1 and data electrodes D1-Dm undergo application of voltage of zero (0V). Scan electrodes SC1-SCn undergo application of voltage with gradually decreasing waveform, starting from voltage Vi3' toward voltage Vi4.

During the application of voltage above, a weak initializing discharge occurs in a discharge cell where a sustain discharge occurred in the sustain period in the previous sub-field. The discharge weakens wall voltage on scan electrode SCi and sustain electrode SUi. As for data electrode Dk, a sufficient amount of positive wall voltage is built up on the electrode. An excessive amount of the wall voltage is used for the initializing discharge, so that a proper amount of wall voltage is left for the addressing operation.

A discharge cell without a sustain discharge in the previous sub-field has no initializing discharge and therefore maintains the wall voltage the same as that at the end of the initializing period of the previous sub-field. As described above, the selective-cell initializing operation is carried out selectively on a discharge cell where the sustain operation occurred in the sustain period of the previous sub-field.

The operations of address period of the selective-cell initializing sub-field are similar to those of the all-cell initializing sub-field and descriptions thereof will be omitted. The operations of the sustain period that follows the address period are also similar to those of the all-cell initializing sub-field except for the number of sustain pulses.

Figure 7:
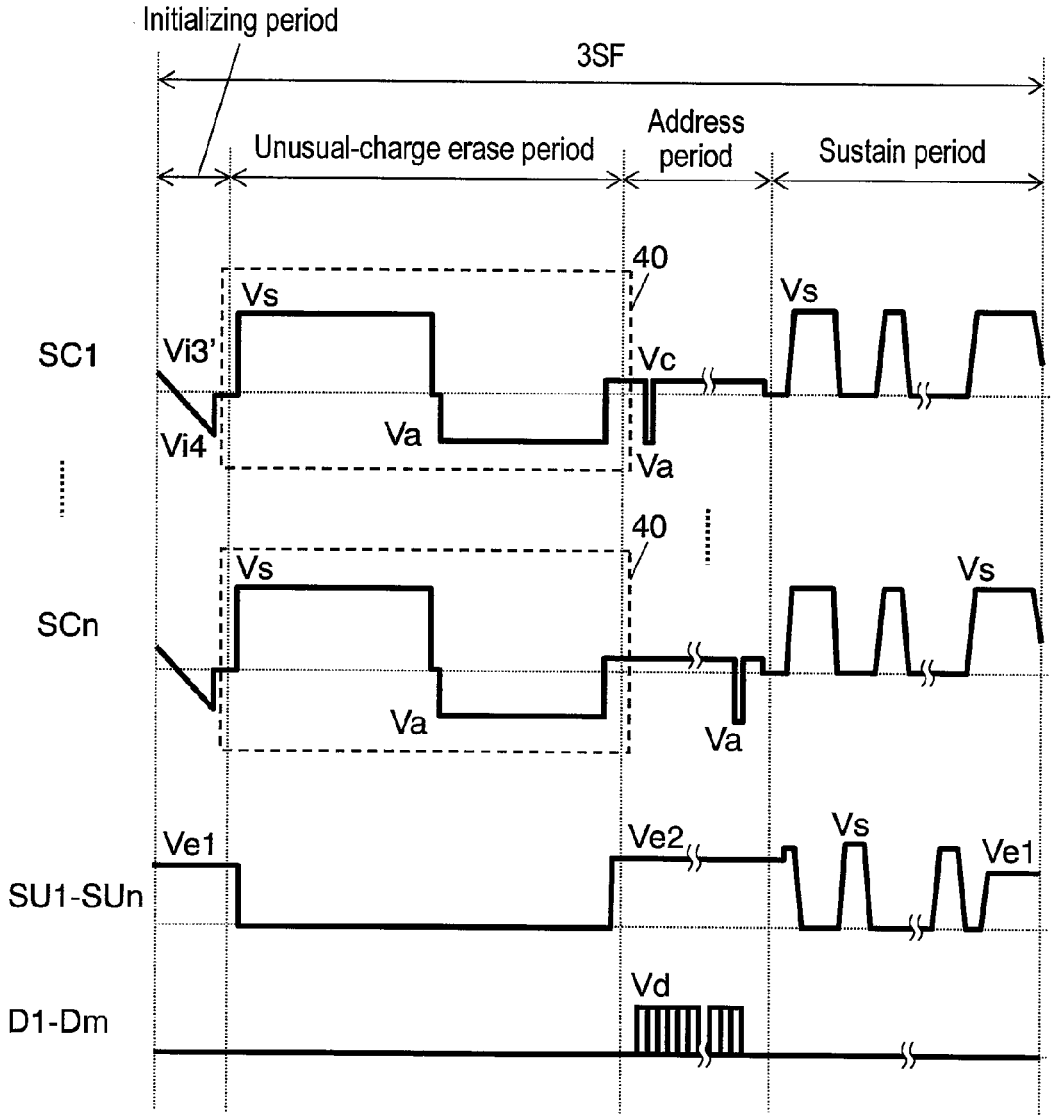
FIG. 7 illustrates the driving voltage waveforms applied to each electrode in the third sub-field (3SF) of the panel in accordance with the first exemplary embodiment.

FIG. 7 illustrates a driving voltage waveform applied to each electrode in the third sub-field (3SF) of panel 10. 3SF is a selective-cell initializing sub-field and has the unusual-charge erase period.

The selective-cell initializing operation in the initializing period, the addressing operation in the address period and the sustain operation in the sustain period of 3SF are the same as those of the selective-cell initializing sub-field without the unusual-charge erase period and the description thereof will be omitted.

As shown in FIG. 7, 3SF has the unusual-charge erase period where the scan electrodes undergo application of voltage with a rectangular waveform. In the unusual-charge erase period, voltage Vs is applied to scan electrodes SC1-SCn and voltage of zero (0V) is applied to the sustain electrodes, with voltage on data electrodes D1-Dm maintained at 0V. The voltage that is applied to each electrode in the unusual-charge erase period is the same in magnitude as voltage Vs as the first sustain pulse applied to scan electrodes SC1-SCn in the sustain period. As is described above, a sustain discharge is not expected in a discharge cell having no address discharge. The unusual-charge erase period is set between the initializing period and the address period; no discharge occurs in the unusual-charge erase period in a normal discharge cell.

In a discharge cell carrying unusual-charges, however, the application of sustain voltage Vs to scan electrodes SC1-SCn can cause a discharge. Besides, the time for application of sustain voltage Vs to the scan electrodes is determined to be longer than the duration of the sustain pulses provided in the sustain period. Compared to the occurrence of a discharge caused by the sustain pulses, a discharge cell carrying unusual-charges is very likely to have a discharge in the unusual-charge erase period. That is, almost of all the discharge cell carrying unusual-charges undergo discharge in the period.

After the application of voltage Vs, negative voltage Va is applied to scan electrodes SC1-SCn, meanwhile the voltage applied to the data electrodes and the sustain electrodes is kept at 0V. The application of voltage Va allows to a discharge cell carrying unusual-charges to have a discharge, erasing the unusual-charges. Erasing unusual-charges makes impossible not only generating a sustain discharge in the sustain period but also performing an addressing operation because the wall charge necessary for the addressing operation is also erased together with the unusual-charges. Such a condition of the discharge cell is not initializing until the cell undergoes the all-cell initializing operation.

The fourth sub-field (4SF) through the tenth sub-field (10SF) are selective-cell initializing sub-fields and have no unusual-charge erase period. The functions of 4SF through 10 SF are the same as that of 2SF shown in FIG. 6 except for the number of sustain pulses provided in the sustain period and the descriptions thereof will be omitted.

Next will be described how to show gradation in the first exemplary embodiment.

FIG. 8 shows the gradation levels and combination of the sub-fields having an addressing operation to achieve each level in accordance with the first exemplary embodiment. In the table, 'o' represents the presence of the addressing operation and '-' represents the absence of the addressing operation. For example, in the discharge cell responsible for showing a gradation level of 0 (that corresponds black color), all the sub-fields of 1SF to 10SF have no the addressing operation. The absence of the addressing operation generates no sustain discharge, providing the lowest level of luminance. In the discharge cell responsible for a gradation level of 1, the addressing operation is carried out in only the cell having a luminance weight of 1 (here in the first embodiment, the cell corresponds to 1SF). Similarly, in the discharge cell responsible for a gradation level of 2, the addressing operation is carried out in only the cell having a luminance weight of 2 (that corresponds to 2SF in the embodiment). As for a gradation level of 3, instead of using 3SF for the addressing operation, the first exemplary embodiment employs a method where 1SF and 2SF carry out the addressing operation, not 3SF only does. Each level of gradation is attained by combination of the sub-field marked with 'o' and the sub-field marked with '-', as shown in FIG. 8. The method employed in the embodiment effects control of the sub-fields in a manner that whenever the addressing operation is carried out in at least any one of 3SF through 10SF, the addressing operation is carried out at least one of 1SF and 2SF. That is, 3SF through 10SF carry out the addressing operation only when at least one sub-field carries out the addressing operation after the all-cell initializing operation in 1SF—when 1SF or 2SF has no addressing operation, so neither do 3SF through 10SF.

According to the first exemplary embodiment, 3SF through 10SF are predetermined sub-fields for carrying out the addressing operation only when at least any one of sub-fields carries out the addressing operation after the all-cell initializing operation; in particular, 3SF comes first of the predetermined sub-fields. Considering this, the unusual-charge erase period is set in 3SF.

In a discharge cell carrying unusual-charges, as described above, a sustain discharge can accidentally occur in the sustain period of each sub-field. Once a sustain discharge appears in a sustain period, the discharge continually occurs until the end of the period. The light emission brought by the unintended sustain discharge can increase the intensity in a sub-field with greater luminance weight, i.e., in a sub-field located in a rearward position in the embodiment. Light emission with intensity from an undesired discharge cell significantly degrades the quality of image display and therefore undesired luminance by unusual-charges should be suppressed as possible. From the reason, the unusual-charge erase period for eliminating the unusual-charges should be set in a forward-located sub-field after the all-cell initializing operation.

However, another problem arises in some cases; under a hostile environment including excessively high or low temperature, a discharge can occur in the unusual-charge erase period in spite of a normal all-cell initializing operation. A discharge cell, which had a discharge in the unusual-charge erase period, no longer has an addressing operation in the address period in the successive sub-field, which can invite poor quality of image display.

A study has found that such a phenomenon mostly appears in a discharge cell with few chances of having a sustain discharge, and generating beforehand a sustain discharge eliminates the inconveniency.

Considering above, in the first exemplary embodiment, the unusual-charge erase period is set in 3SF, not in 1SF that is the first sub-field after the all-cell initializing operation. When the addressing operation occurs in 1SF or 2SF, a sustain discharge follows it in 1SF or 2SF. This prevents the unusual-charge erase period of 3SF from having a discharge, thereby carrying out a normal addressing operation after that. On the other hand, in a case where 1SF or 2SF has no addressing operation, a sustain discharge can occur in the unusual-charge erase period of 3SF. However, there is no ill effect on image quality. As described above, 3SF through 10SF carry out the addressing operation only when at least one sub-field carries out the addressing operation after the all-cell initializing operation in 1SF—as long as 1SF or 2SF has no addressing operation, there is no chance of the addressing operation carried out in 3SF or later sub-fields.

Figure 9:
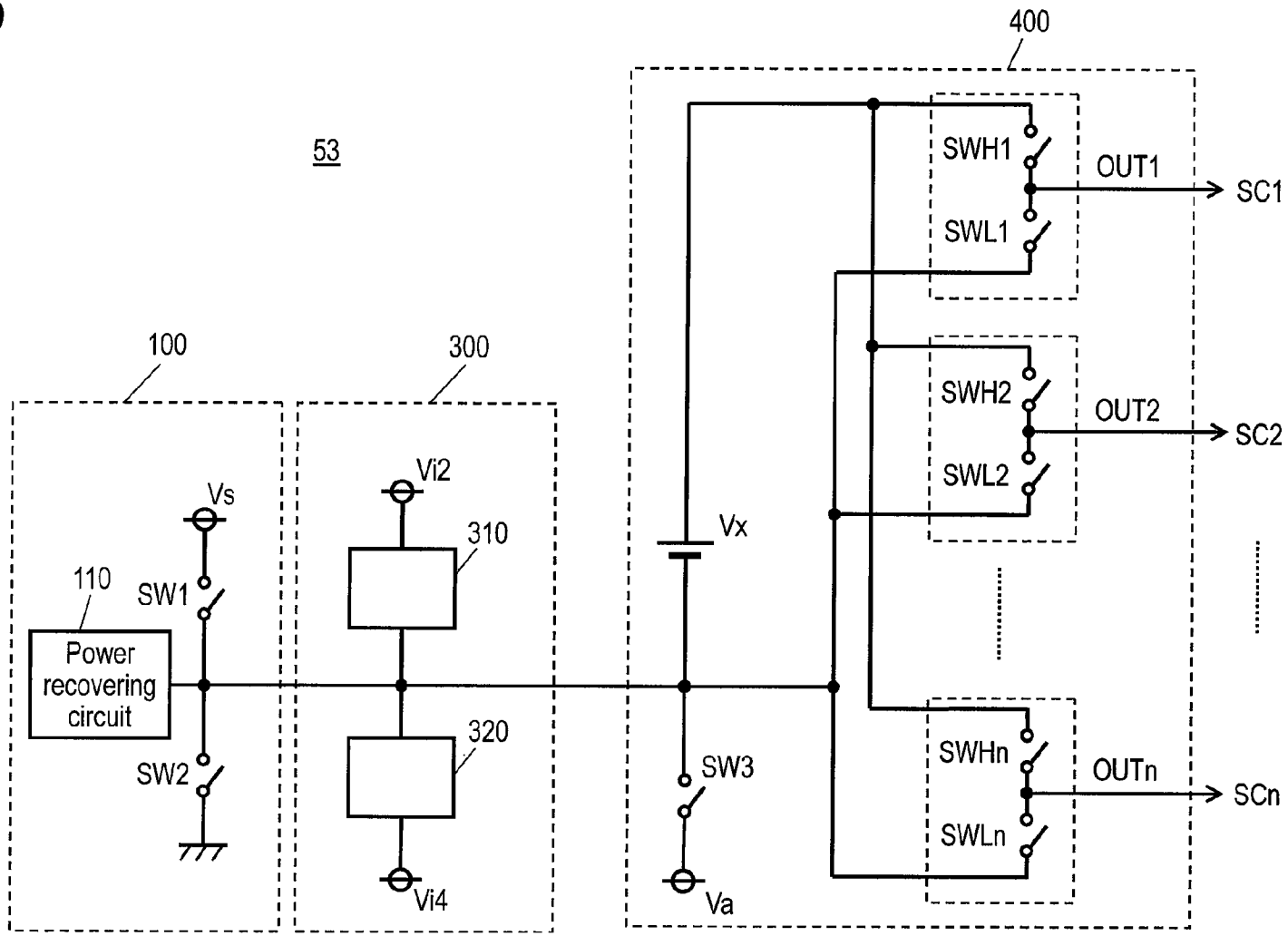
FIG. 9 is a circuit block diagram of the driving circuit for driving scan electrodes in accordance with the first exemplary embodiment.

Here will be described how to generate driving voltage waveform 40 used for the unusual-charge erase period. FIG. 9 is a circuit diagram showing scan-electrode driving circuit 53 in accordance with the first exemplary embodiment. Scan-electrode driving circuit 53 has sustain-pulse generating circuit 100 for generating a sustain pulse, initializing-waveform generating circuit 300 for generating a initializing waveform and scan-pulse generating circuit 400 for generating a scan pulse. Sustain-pulse generating circuit 100 further contains power recovering circuit 110 and switching elements SW1, SW2. Power recovering circuit 110 recovers electric power used for driving scan electrodes 22 for reuse. Switching element SW1 clamps voltage applied to scan electrodes 22 at voltage Vs; similarly, switching element SW2 clamps it at 0V.

Initializing-waveform generating circuit 300 further contains Miller integrators 310, 320. Miller integrator 310 generates voltage with gradually increasing waveform in the initializing period, whereas Miller integrator 320 generates voltage with gradually decreasing waveform.

Scan-pulse generating circuit 400 further contains power supply Vx, switching element SW3 and switching sections OUT1 through OUTn. Power supply Vx generates voltage Vc in the address period. Switching element SW3 clamps the lower side of power supply at voltage Va. Switching sections OUT1-OUTn output scan pulses to be applied to scan electrodes SC1-SCn, respectively. Switching sections OUT1-OUTn contain switching elements SWH1-SWHn for outputting voltage Vc and switching elements SWL1-SWLn for outputting voltage Va, respectively. FIG. 9 shows, for sake of clarity, switching elements SWH1 and SWL1 of switching section OUT1; switching elements SWH2 and SWL2 of switching section OUT2; and switching elements SWHn and SWLn of switching section OUTn.

Figure 10:
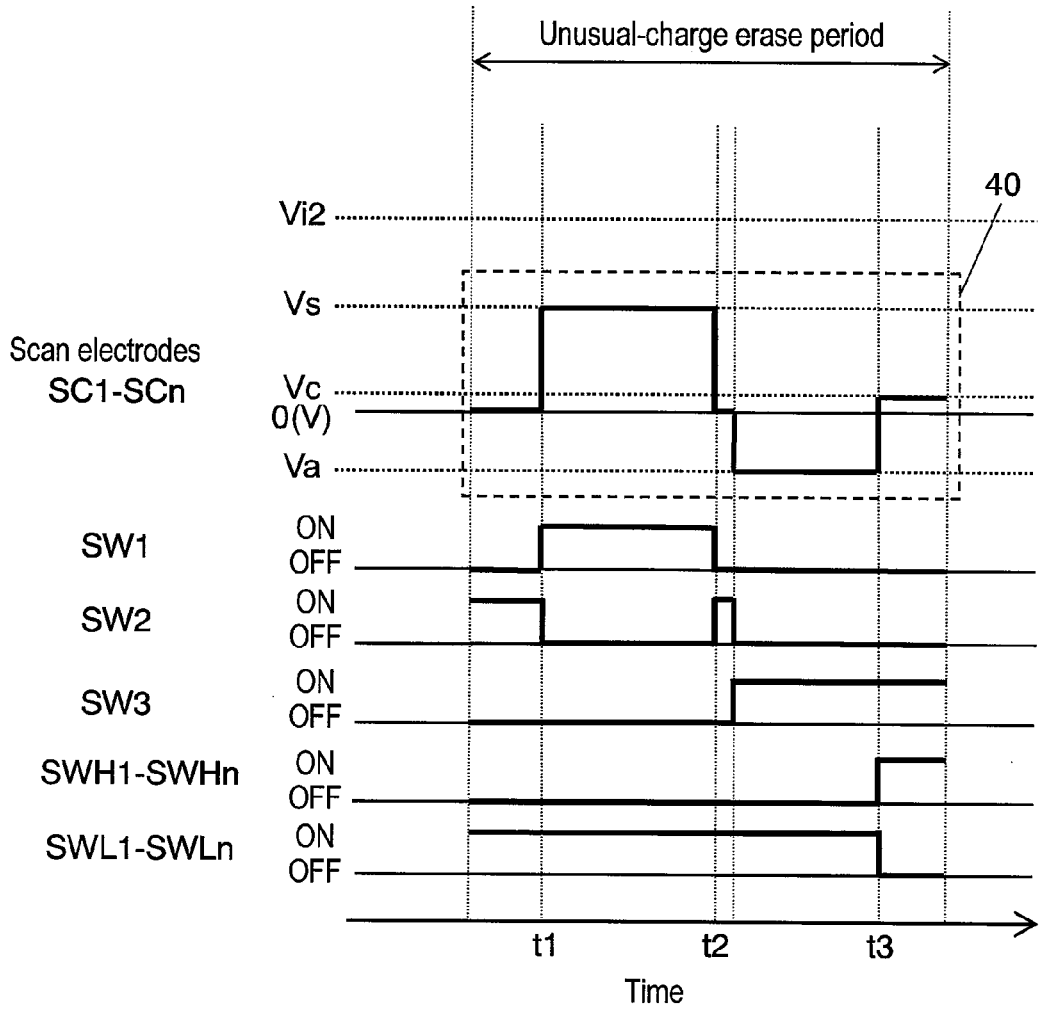
FIG. 10 is a timing diagram illustrating the workings of the driving circuit for the scan electrodes in an unusual-charge erase period in accordance with the first exemplary embodiment.

Next will be described the workings of scan-electrode driving circuit 53. FIG. 10 is a timing diagram illustrating the workings of scan-electrode driving circuit 53 in the unusual-charge erase period. In the description below, for convenience sake, a switching element that is brought into conduction is described as a "turned ON element"; similarly, a switching element out of conduction is described as a "turned OFF element".

FIG. 10 illustrates the workings of the scan-electrode driving circuit on the assumption that voltage of zero (0V) has already applied to scan electrodes SC1-SCn by time t1. That is, switching element SW2 of sustain-pulse generating circuit 100 and switching elements SWL1-SWLn of switching sections OUT1-OUTn are turned ON and the rest of the switching elements are turned OFF.

At time t1, switching element SW1 is turned ON and switching element SW2 is turned OFF. Upon the switching above, voltage Vs is applied to scan electrodes SC1-SCn via switching element SW1 and switching elements SWL1-SWLn. Through the application of voltage, positive wall voltage is built up on scan electrodes SC1-SCn, while negative wall voltage is built up on sustain electrodes SU1-SUn in a discharge cell carrying unusual-charges. Difference in voltage between the scan electrodes and the sustain electrodes exceeds the value of discharge starting voltage, so that a discharge occurs. Through the discharge, negative wall voltage is built up on scan electrodes SC1-SCn and positive wall voltage is built up on sustain electrodes SU1-SUn. A discharge hardly occurs in a discharge cell with no unusual-charges except for some rare cases; under an excessive harsh operating environment, a discharge can occur in a discharge cell with few chances of generating a sustain discharge.

At time t2, switching element SW1 is turned OFF and switching element SW2 is turned ON of sustain-pulse generating circuit 100, and voltage Vs, which has been applied to scan electrodes SC1-SCn, is returned to 0(V). After that, switching element SW2 of sustain-pulse generating circuit 100 is turned OFF and switching element SW3 of scan-pulse generating circuit 400 is turned ON. Upon the switching above, voltage Va is applied to scan electrodes SC1-SCn via switching element SW2 and switching elements SWL1-SWLn. Through the application of voltage, difference in voltage between the scan electrodes and the sustain electrodes exceeds the value of the discharge starting voltage again, so that a discharge occurs. At this time, the voltage applied to sustain electrodes SU1-SUn is kept at 0(V). The difference in voltage between the scan electrodes and the sustain electrodes exceeds but with a modest excess over the value of discharge starting voltage. As a result, the wall voltage on scan electrodes SC1-SCn and on sustain electrodes SU1-SUn is eliminated.

On the other hand, in a discharge cell carrying no unusual-charges, voltage lower than the discharge starting voltage is applied to the electrodes. The application of voltage is not sufficient to generate a discharge, so that wall voltage on the electrodes are maintained the same as the state at the end of the initializing period.

At time t3, switching elements SWL1-SWLn of switching sections OUT1-OUTn are turned OFF and switching elements SWH1-SWHn are turned ON. Upon the switching above, voltage Vc is applied to scan electrodes SC1-SCn. After that, the address period starts. As described above, scan-electrode driving circuit 53 effects control on the switching elements so that voltage with a rectangular waveform is applied to scan electrodes SC1-SCn.

The time interval between time t1 and time t2 should preferably be 5 μsec to 30 μsec. In the first embodiment, the interval between time t1 and time t2 is set at 10 μsec. Similarly, the time interval between time t2 and time t3 should preferably be 1 μsec to 30 μsec. In the embodiment, the interval between t2 and t3 is set at 10 μsec.

Second Exemplary Embodiment

In the first exemplary embodiment, 3SF is the sub-field having the unusual-charge erase period (hereinafter, the unusual-charge erase sub-field). However, in a case where the number of sustain pulses provided in the sustain period of 1SF or 2SF are few in number, the unusual-charge erase period may be set in a sub-field that comes behind 3SF.

Figure 11:
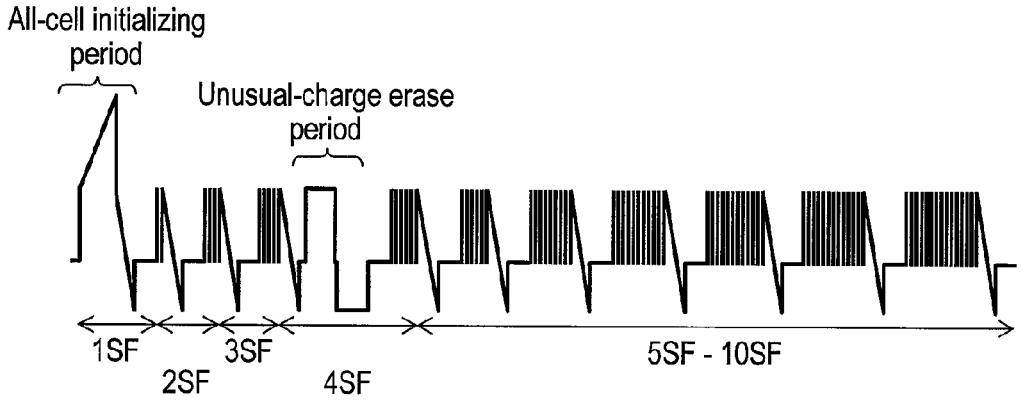
FIG. 11 shows the structure of the sub-fields in accordance with a second exemplary embodiment.

FIG. 11 shows the structure of the sub-fields in accordance with the second exemplary embodiment. 1SF serves as an all-cell initializing sub-field and 2SF through 10SF serve as selective-cell initializing sub-fields. The structure of the embodiment differs from that of the first embodiment in that the unusual-charge erase period is set in 4SF only. FIG. 11 schematically shows the driving voltage waveform in one field of a panel; as for details on the waveform of each sub-field, see FIG. 5 and FIG. 6.

The driving control of the second embodiment, like in the first embodiment, is so structured that whenever the addressing operation is carried out in a sub-field located behind 3SF, the addressing operation is carried out in at least one of 1SF and 2SF. For example, when the addressing operation is carried out in 4SF, the addressing operation is carried out in 1SF or 2SF without exception.

As described in the previous embodiment, when a panel is used under a hostile environment, a discharge can occur in the unusual-charge erase period in spite of the normal all-cell initializing operation, and the undesired discharge can be eliminated by generating beforehand a sustain discharge. However, in a discharge cell that undergoes a sustain discharge but the occurrence frequency of the discharge is excessively low, a discharge can occur in the unusual-charge erase period. Besides, when the sub-fields with a small luminance factor are employed, 1SF has the fewest number of sustain pulses because of its smallest luminance weight. Under the circumstance, a discharge can occur in the unusual-charge erase period in spite of the fact that a sustain discharge occurred in 1SF.

According to the second embodiment, the unusual-charge erase period is set in 4SF behind 3SF. The structure increases the frequency and probability of occurrence of a sustain discharge before the unusual-charge erase sub-field. This further suppresses the undesired phenomenon—a discharge can occur in the unusual-charge erase period in spite of the normal all-cell initializing operation. According to the second embodiment, as described above, the sub-fields are so structured that predetermined sub-fields carry out an addressing operation only when at least one sub-field carries out an addressing operation after the all-cell initializing operation. At the same time, an unusual-charge erase period, in which voltage with a rectangular waveform is applied to the scan electrodes, is set after the initializing period of the sub-field at the second of the predetermined sub-fields. The structure above minimizes the chances of undesired discharge in the unusual-charge erase period in a discharge cell that undergoes a sustain discharge but the occurrence frequency of the discharge is excessively low.

The unusual-charge erase period may be set in a sub-field at the third or later of the predetermined sub-fields; the period should be in an optimal sub-field according to the characteristics of a panel.

The number of sub-fields and luminance weight assigned to each sub-field are not necessarily the same as those described in the embodiments above; at the same time, the number of sub-fields and luminance weight can be employed for other sub-field methods.

Besides, the values described in the second exemplary embodiment are just a few examples; they should be properly determined according to characteristics of a panel and specifications of a plasma display device.

INDUSTRIAL APPLICABILITY

The present invention provides a driving method capable of suppressing degradation of image quality due to a lighting error. This is therefore useful for driving a plasma display panel and a plasma display device.

The invention claimed is:

1. A method for driving a plasma display panel having a plurality of discharge cells with a display electrode that is formed of a pair of a scan electrode and a sustain electrode, wherein the method effects gradation control of the plasma display panel in a manner that one field is formed of a plurality of sub-fields, each sub-field having an initializing period for generating an initializing discharge in the discharge cells, an address period for carrying out an addressing operation in the discharge cells and a sustain period for generating a sustain discharge in the discharge cells where an address discharge is generated by the addressing operation, the initializing period of at least one of the sub-fields undergoes an all-cell initializing operation for carrying out the initializing operation on all of the discharge cells for image display;

when at least one sub-field carries out the addressing operation after the all-cell initializing operation, a subsequent plurality of predetermined sub-fields carry out the addressing operation in the respective address period, the predetermined sub-fields corresponding to a predetermined gradation level, and at least one of the predetermined sub-fields includes an unusual-charge erase period between the initializing period and the address period, the unusual-charge erase period includes application of a voltage with a rectangular waveform including a positive voltage and a negative voltage applied to the scan electrode, wherein the negative voltage is following the positive voltage.

2. The method for driving a plasma display panel of claim 1, wherein the unusual-charge erase period is included in a first of the predetermined sub-fields.

3. The method for driving a plasma display panel of claim 1, wherein the unusual-charge erase period is included in a second of the predetermined sub-fields.

4. A plasma display device comprising:

a plasma display panel having a plurality of discharge cells with a display electrode formed of a pair of a scan electrode and a sustain electrode; and a driving circuit for driving the plasma display panel, the driving circuit effecting gradation control of the plasma display panel in a manner that one field is formed of a plurality of sub-fields, each sub-field having an initializing period for generating an initializing discharge in the discharge cells, an address period for carrying out an addressing operation in the discharge cells and a sustain period for generating a sustain discharge in the discharge cells where an address discharge is generated by the addressing operation, wherein, the driving circuit effects control of the sub-fields as follows:

carrying out an all-cell initializing operation at the initializing period of at least one of the subfields for generating the initializing operation on all of the discharge cells responsible for image display;

providing a subsequent plurality of predetermined sub-fields that undergo the addressing operation when at least one sub-field includes an addressing operation after the all-cell initializing operation, the predetermined sub-fields corresponding to a predetermined gradation level; and applying a voltage with a rectangular waveform including a positive voltage and a negative voltage to the scan electrode between the initializing period and the address period of at least one sub-field of the predetermined sub-fields, wherein the negative voltage is following the positive voltage.

* * * * *